US012042705B2

(12) United States Patent
Pegnatori

(10) Patent No.: US 12,042,705 B2
(45) Date of Patent: Jul. 23, 2024

(54) BASEBALL BAT

(71) Applicant: Carl Pegnatori, Calimesa, CA (US)

(72) Inventor: Carl Pegnatori, Calimesa, CA (US)

( * ) Notice: Subject to any disclaimer, the term of this patent is extended or adjusted under 35 U.S.C. 154(b) by 0 days.

(21) Appl. No.: 17/410,862

(22) Filed: Aug. 24, 2021

(65) Prior Publication Data

US 2021/0379454 A1 Dec. 9, 2021

Related U.S. Application Data

(63) Continuation of application No. 16/733,232, filed on Jan. 2, 2020, now Pat. No. 11,097,171.

(51) Int. Cl.

| | |
|---|---|
| ***A63B 59/58*** | (2015.01) |
| ***A63B 60/54*** | (2015.01) |
| *A63B 102/18* | (2015.01) |

(52) U.S. Cl.

CPC ..... *A63B 59/58* (2015.10); *A63B 60/54* (2015.10); *A63B 2102/18* (2015.10); *A63B 2102/182* (2015.10); *A63B 2209/00* (2013.01)

(58) Field of Classification Search

CPC ..... A63B 59/58; A63B 2102/182; A63B 2209/00; A63B 2102/18; A63B 60/54; A63B 59/50; A63B 59/59; A63B 59/51; A63B 59/55

See application file for complete search history.

(56) References Cited

U.S. PATENT DOCUMENTS

| | | | | |
|---|---|---|---|---|
| 5,415,398 | A * | 5/1995 | Eggiman | A63B 59/50 473/566 |
| 5,511,777 | A * | 4/1996 | McNeely | A63B 59/51 473/566 |
| 6,663,517 | B2 * | 12/2003 | Buiatti | A63B 60/54 473/566 |
| 7,867,114 | B2 * | 1/2011 | Sutherland | A63B 59/50 473/567 |
| 7,985,149 | B2 * | 7/2011 | Watari | A63B 59/50 473/566 |
| 8,602,924 | B2 * | 12/2013 | Shindome | A63B 59/56 473/566 |
| 8,632,428 | B2 * | 1/2014 | Burger | A63B 59/50 473/566 |
| 9,005,056 | B2 * | 4/2015 | Pegnatori | A63B 59/54 473/566 |
| 9,138,625 | B2 * | 9/2015 | Chung | A63B 59/52 |
| 10,583,340 | B2 * | 3/2020 | Lanyon | A63B 60/54 |
| 11,097,171 | B2 * | 8/2021 | Pegnatori | A63B 59/58 |
| 2002/0091022 | A1 * | 7/2002 | Fritzke | A63B 59/51 473/566 |
| 2002/0094892 | A1 * | 7/2002 | Chauvin | A63B 59/51 473/566 |

(Continued)

*Primary Examiner* — Steven B Wong

(74) *Attorney, Agent, or Firm* — Foundation Law Group LLP; Sevag Demirjian; J D Harriman

(57) ABSTRACT

A hollow non-wood baseball or softball bat wherein the impact portion of the bat contains an inner multi-walled barrel that is positioned by means of a (i) foam insert, (ii) tube extending from the bat's knob, or (iii) line attached to the bat's knob and end cap and extending throughout the bat such that the inner barrel does not come into contact with the inside wall of the bat when the bat is at rest yet when swung the inner barrel is allowed to move so as to amplify the rebound effect given to the ball upon impact with the bat.

5 Claims, 6 Drawing Sheets

(56) References Cited

U.S. PATENT DOCUMENTS

| | | | | |
|---|---|---|---|---|
| 2003/0004020 | A1* | 1/2003 | Ogawa | A63B 59/52<br>473/564 |
| 2005/0221924 | A1* | 10/2005 | Sutherland | A63B 60/54<br>473/566 |
| 2008/0070726 | A1* | 3/2008 | Watari | A63B 59/50<br>29/455.1 |
| 2009/0280935 | A1* | 11/2009 | Watari | A63B 59/56<br>473/566 |
| 2011/0105255 | A1* | 5/2011 | Watari | A63B 59/50<br>473/566 |
| 2014/0080642 | A1* | 3/2014 | Epling | A63B 60/08<br>156/293 |
| 2020/0330838 | A1* | 10/2020 | Goodwin | A63B 59/54 |

* cited by examiner

BASEBALL BAT

This patent application claims priority to U.S. patent application Ser. No. 16/733,232 filed on Jan. 2, 2020, which is incorporated by reference herein in its entirety.

BACKGROUND OF THE SYSTEM

High performance baseball and softball bats, hereinafter referred to simply as "baseball bats" or "bats", are primarily made from aluminum alloys, composite materials, or some combination thereof. These bats are tubular (hollow inside) so as to optimize their weight and they consist of three sections: a relatively narrow handle portion for gripping, a relatively wider distal portion for hitting, and a tapered mid-section connecting the handle and hitting portions. Original aluminum bats were fabricated as a single piece in that they solely consisted of a frame with nothing occupying the space within the frame. It was found that these bats outperformed traditional wooden bats because of a "rebound" effect present in aluminum/composite bats. As the ball impacted the bat, the bat wall would absorb the energy from the impact by elastically deforming the wall at the point of impact. As the ball began to leave the bat the energy absorbed by the elastic deformation would be released by the wall returning to its original structure, in effect giving the ball an extra "push", thus the rebound effect. Another name given to this effect is the "trampoline" effect. Manufacturers of bats found that by making the wall thinner the rebound effect would be magnified. However thinner walls also decreased the life of the bat as the wall would fatigue and no longer return to its original position; leaving dents or dings on the bat. As a result manufacturers begin to look at ways of utilizing the cavity within the hitting portion of the bat to increase the rebound effect and reduce fatigue.

A number of designs were introduced to take advantage of the space available in the cavity of the bat's hitting portion with the goal of strengthening the hitting portion while maintaining or improving the rebound effect. Some designs would decrease the width of the cavity so as to add an outer tubular sleeve while other designs would add tubular inserts within the cavity of the bat's hitting portion. These designs became to be known as multi-walled bats. Still other designs added composites to the outer wall or disks within the cavity to strengthen the wall while maintaining its flexing properties. These designs continued to be known as single wall bats. As this disclosure is for a bat with a novel method of utilizing a tubular insert this discussion will focus on multiwall bat disclosures.

Multiwall bat designs may be broken down into two groups. The first group have walls that are distinct from each other yet each wall directly and continuously adjoins adjacent walls. Although the walls may flex independently from each other the fact that they adjoin one another only allows for minor improvements to the rebound effect. The second group have walls where a gap(s) between the walls have been purposefully incorporated. The gap(s) allow for greater independent flexing of the walls with a corresponding greater improvement of the rebound effect so that the rebound effect may increase more linearly.

Examples of bats with multiple walls that directly abuts one another include U.S. Pat. No. 5,303,917 to Uke and U.S. Pat. No. 6,440,017 to Anderson which both discloses a bat with a sleeve over the outside of the hitting portion that directly and continuously adjoins the frame of the bat's hitting portion. Examples of bats with internal walls, referred to as inserts, includes U.S. Pat. No. 5,364,095 to Easton which discloses an internal insert bonded to the inside of the external metal tube and running the full length of the hitting portion of the bat and U.S. Pat. No. 6,425,836 to Misono et al. which discloses an internal insert with a weak boundary layer so as to encourage some amount of independent flexing. The advantage of these designs is simplicity in manufacturing. Since the walls directly and continuously adjoin each other they are less likely to separate. However this simplicity comes at a cost to performance as less energy is absorbed from the ball's impact with the bat resulting in a less than desired rebound effect.

Examples of bats with multiple walls that incorporate some sort of gap between the walls include U.S. Pat. No. 5,415,398 to Eggiman which discloses a bat with a tubular insert that is placed within the bat's hitting portion. The outside diameter of the insert is smaller than the inside diameter of the bat's outer shell so that there exists an annular gap between the two. The outside shell and tubular insert are therefore able to flex independently and, by so doing, together act as a leaf spring, resulting in greater bat performance. To prevent the insert from moving about within the frame it is secured by friction fit or fasteners. Another example is U.S. Pat. No. 6,612,945, also to Anderson, that contains a spiral inspired textured insert that makes contact with the bat's frame at each apex of the spiral. While the two walls are not as independent as the Eggiman patent they do act with greater independence than walls that directly and continuously adjoin one another. The spiral inspired textured insert is seated against a buttress at one end of the hitting portion and secured by the bat's end cap at the opposite end of the hitting portion. A final example is U.S. Pat. No. 8,007,381 to Watari et al. which discloses a bat with sleeve that fits over the outside of the hitting portion with an inside diameter larger than the outside diameter of the bat's frame such that a gap exists between the two. The sleeve is secured to the bat's frame by both structural elements and adhesives at both ends of the sleeve. The walls in multiwall bats that contain gaps between the walls are able to absorb more energy from an impact with a ball as they are able to flex with greater independence from each other. The increase in flexing in turn improve the bat's rebound effect and performance.

However all of the designs presented here are, in essence, single wall designs as the separate walls are securely connected or make contact, either continuously or at two or more points, with each other. As a result energy absorbed by the bat is transmitted to each wall at multiple points, not just the point of impact. Additionally the walls, since they are connected to each other, freely allow energy absorbed as vibrations to travel along the full length of the bat's frame and every structural element attached to the bat's frame.

On impact with a ball a bat absorbs energy by two means; flexing and vibrating. Energy that flexes the wall leads to improved rebound effect. In the multiwall designs presented here the walls will flex at each point they are in contact with each other. Using the Eggiman patent as an example the inner wall will flex at the two points where it is secured to the outer wall and where the ball impacts with the outer wall. Although most of the energy that flexes the inner wall will be at the point of impact some flexing energy will "bleed away" at the other two points where the inner wall is secured to the outer wall and correspondingly reduce the amount of flexing at the point of impact. When a ball impacts a bat the bat will vibrate. Although the bat will always vibrate the amount of vibrations may sometimes be felt by the batter and can lead to the batter experiencing a "stinging" sensation in their hands. Energy absorbed as vibrations adversely affects the rebound effect in two ways. First it can be easily seen that vibration energy directly subtracts from flexing energy in that the more energy absorbed by vibration the less energy is available to be absorbed for flexing. Vibrations also adversely impact the rebound effect by actively working against the wall flexing. Vibrations are an oscillatory effect creating an equal amount of movement away from a resting point. As the wall is flexed energy will have to be expended to overcome the vibrations resulting in a reduction of the energy used to flex the wall and therefore a less than optimal rebound effect.

The prior art designs presented herein provide for a less than optimal rebound effect by means of the multiple points of contact between the walls and the multiple points of contact allow vibrations to spread throughout the bat.

SUMMARY

A hollow non-wood baseball or softball bat wherein the impact portion of the bat contains an inner multi-walled barrel that is positioned by means of a (i) foam insert, (ii) tube extending from the bat's knob, or (iii) line attached to the bat's knob and end cap and extending throughout the bat such that the inner barrel does not come into contact with the inside wall of the bat when the bat is at rest yet when swung the inner barrel is allowed to move so as to amplify the rebound effect given to the ball upon impact with the bat.

DETAILED DESCRIPTION OF THE SYSTEM

The system provides an improved baseball bat that includes a multi-walled inner barrel to enhance the rebound power of the bat wall. U.S. Pat. No. 9,005,056 and assigned to the assignee of the present application describes a bat having an inner barrel that does not come into contact with the inside wall of the bat when the bat is at rest. The present system provides a multi-layer floating insert.

Figure 1:
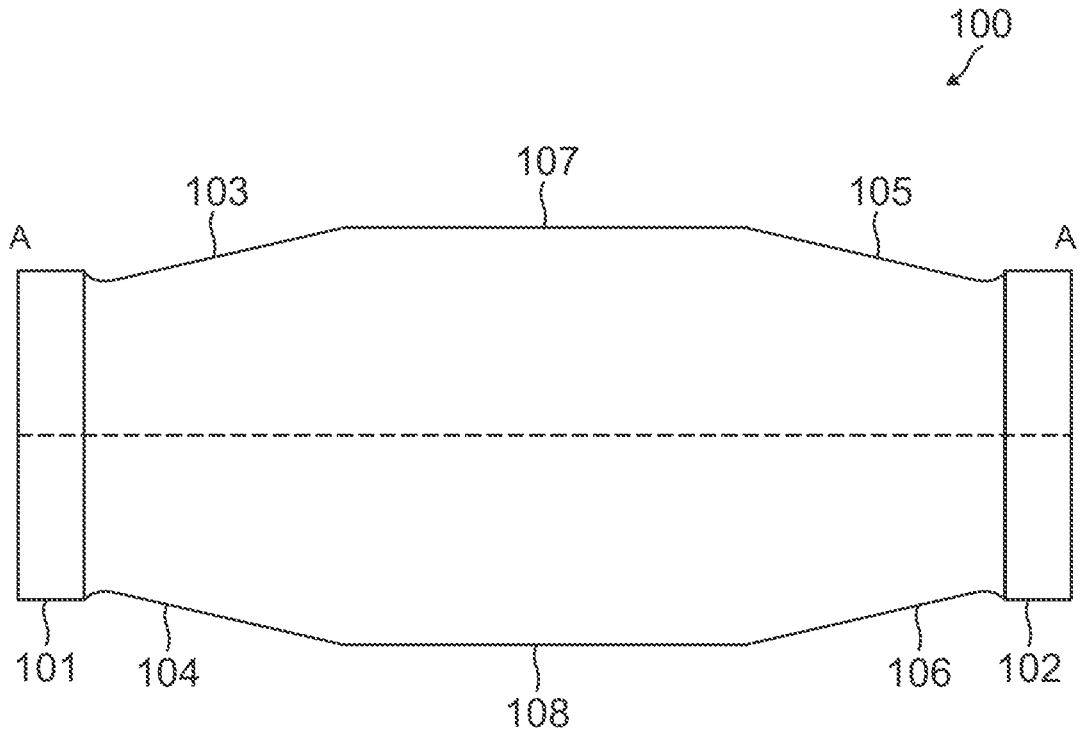
FIG. 1 is a plan view of a bat insert in an embodiment of the system.

FIG. 1 is a side view of a bat insert one embodiment of the system. The insert 100 has a diameter at its widest point that is less than the inner diameter of a bat. In one embodiment, the insert is intended to be placed inside of a hollow bat, such as an aluminium bat, in a manner where the insert 100 does not touch the inner wall of the bat when the bat is at rest. The insert 100 includes two end portions 101 and 102 that have the same dimensions. Starting at end portion 101, the insert widens at regions 103 and 104 to the maximum size at regions 107 and 108. At regions 105 and 106, the insert 100 begins to reduce in size until reaching end portion 102.

In one embodiment, at least a portion of the outer surface of the insert touches the inner surface of the barrel of the bat and is in continuous contact with the inner surface of the barrel of the bat during operation.

Figure 3:
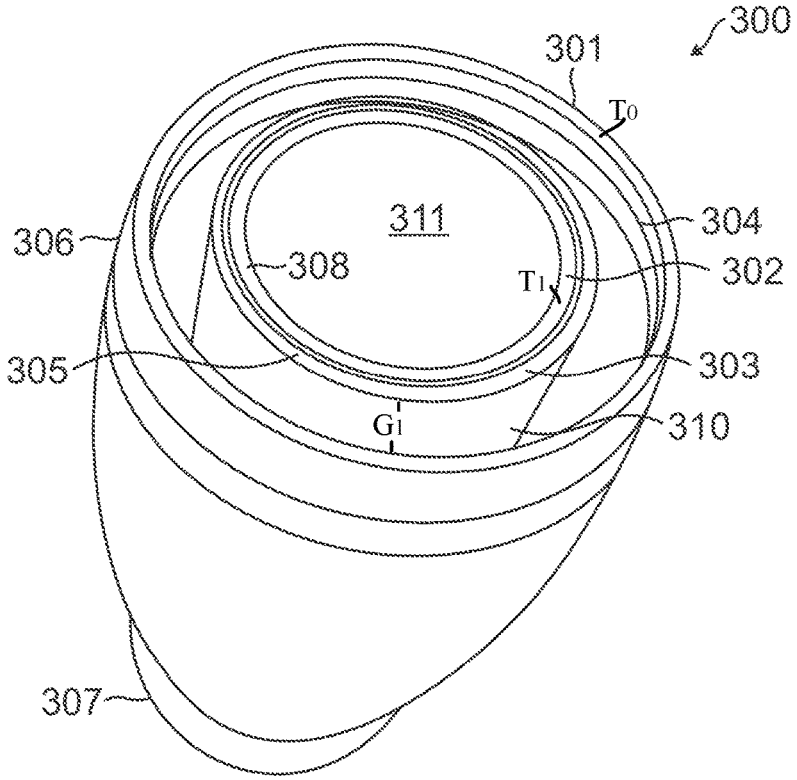
FIG. 3 is a cross sectional view of a bat insert in an embodiment of the system.
Figure 4:
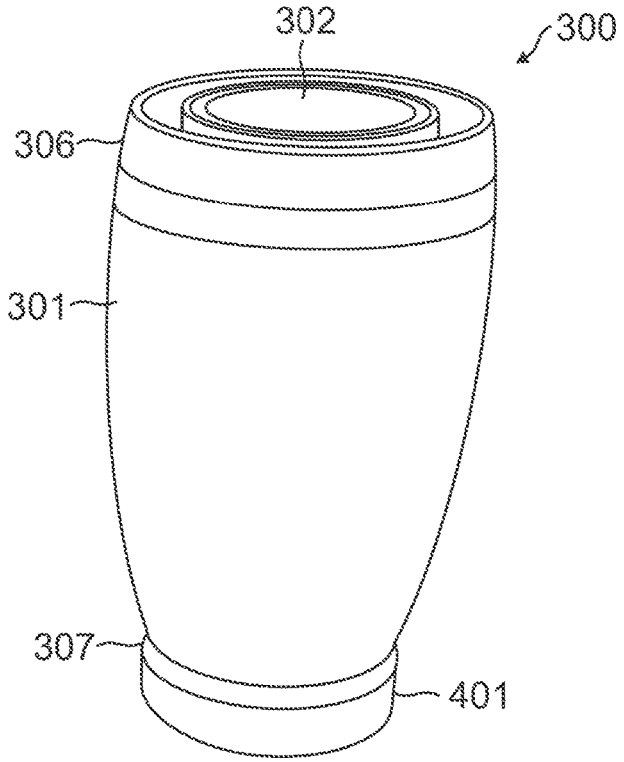
FIG. 4 is side view of the bat insert of FIG. 3.
Figure 5:
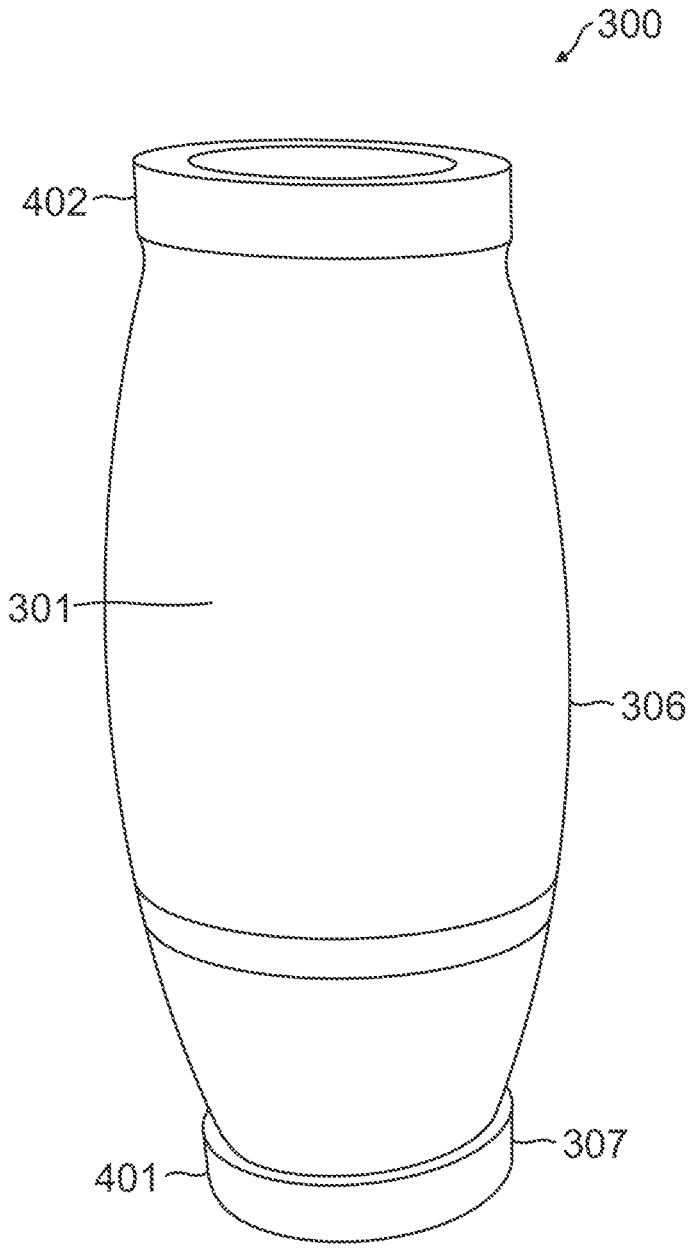
FIG. 5 is a whole side view of the bat insert of FIGS. 3 and 4.
Figure 6:
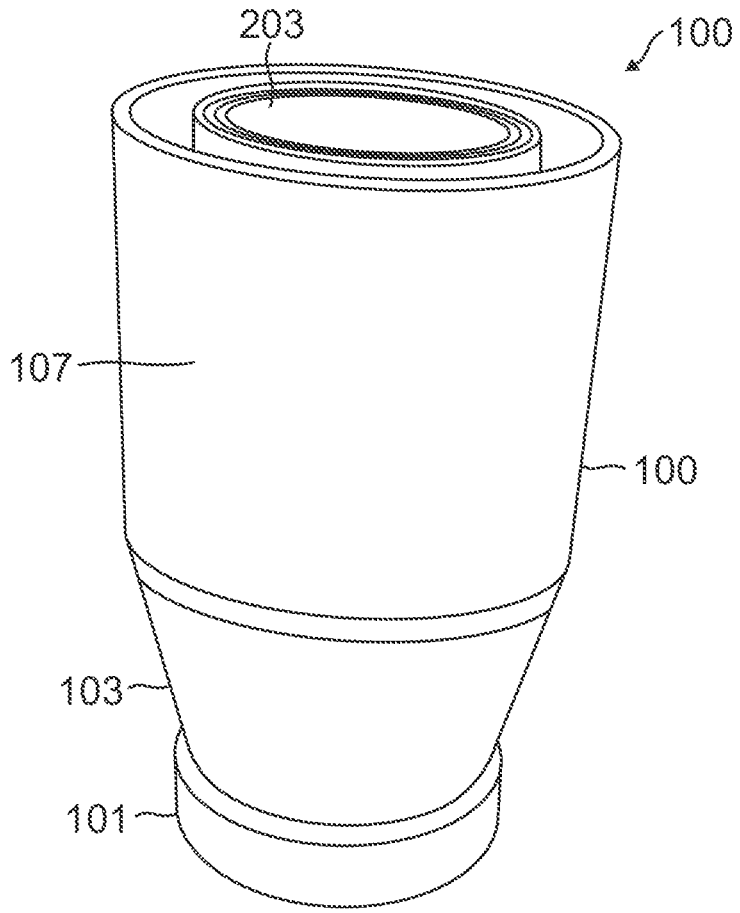
FIG. 6 is a side view of a portion of a bat insert of an embodiment of FIGS. 1 and 2.

In the embodiment of FIG. 1, the insert is shown as having a straight angle at regions 103, 104, 105, and 106 extending to regions 107 and 108, which are shown as flat in FIG. 1 and in FIG. 6. It will be understood that the insert may instead have a more arcuate expansion from a minimum at end portion 101 to a maximum at the middle of regions 107 and 108 respectively, and a continuing arcuate lessening to end portion 102 as shown in FIGS. 3-5 below. Any suitable shape can be utilized in the system as long as the maximum width of the insert is less than the diameter of the inner wall of the bat. In one embodiment the width at regions 107 and 108 may be identical to end portions 101 and 102.

Figure 2:
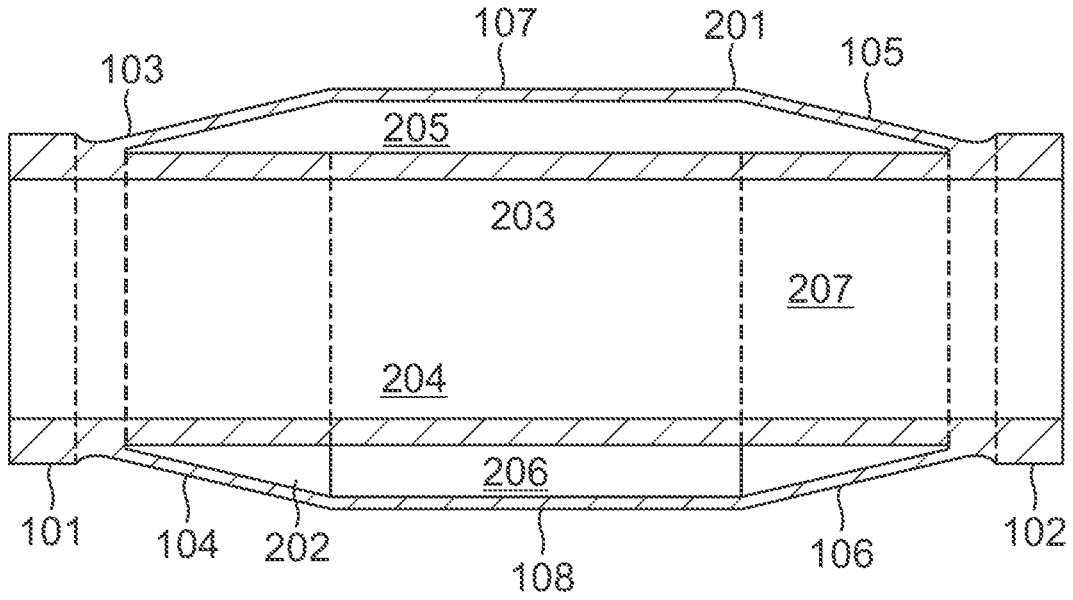
FIG. 2 is a cross sectional view of the insert of FIG. 1 along lines A-A.

FIG. 2 is a cross sectional view of the insert 100 of FIG. 1, taken along section lines A-A of FIG. 1. Similar elements have the same element numbers in FIG. 1 and FIG. 2. As can be seen, the insert 100 is a multi-walled configuration. The outer wall is shown at 201 and 202 (note that because the insert is round, there is a single outer wall). An inner wall is shown at 203 and 204. The inner wall is also round in one embodiment, so comprises a single wall. An air gap 205 is shown between outer wall 201 and inner wall 203. Similarly, there is an air gap 206 between outer wall 202 and inner wall 204. As shown in FIG. 2 the diameter of the inner wall does not vary over the length of the insert. In one embodiment, the gap may be filled with some other material or fluid, including, but not limited to foam, oil, water, and the like.

FIG. 3 is a cross sectional view across the axis of a bat insert in an embodiment of the system. The insert 300 is substantially circular in cross section with a width at it widest point 306 tapering down to its minimum width at point 307. The insert 300 comprises an outer wall 301 having a thickness $T_O$. The insert includes an inner wall 302 having a thickness $T_I$.

There is a gap $G_I$ between outer wall 301 and inner wall 302. The thickness of $G_I$ varies from the narrow end of the insert 300 to the widest point of the insert 300.

In one embodiment, inner wall 302 is itself comprised of two walls 308 and 310 with a gap 305 therebetween. A series of spacers formed in gap 305 help maintain the distance between the walls 308 and 310

The center region of insert 300 is a hollow shaft 311 that is air filled in one embodiment. The insert may be comprised of any suitable rigid material, including metal, carbon fiber, titanium, poly or plastic, and the like.

FIG. 4 is a side view of the insert of FIG. 3. The insert 300 shows the arcuately curved outer wall 301 narrowing from its widest point 306 to its narrowest point 307, ending in end portion 401. The full shape of the insert 300 can be seen in FIG. 5 in one embodiment. The insert 300 has a curved shape from the narrowest region 307 at end portion 401, widening gradually to the widest point 306 at the middle of the insert 300, and then narrowing again to end portion 402.

FIG. 6 illustrates the shape of the embodiment of FIGS. 1 and 2. The insert 300 has end portion 101. A flat region 103 expands in a substantially straight line to straight region 107. Having a substantially straight region 107 in the middle of the insert provides a "sweet spot" that extends over a greater length. This allows high performance results over a larger surface are of the bat itself, providing a better hitting instrument.

In operation, the bat insert is used with a tubular bat having a large diameter barrel portion that tapers to a narrow handle having a knob on the end thereof. The top of the tubular bat has a cap to cover the cavity of the bat. When the bat is at rest, the bat insert does not make any contact with the inner wall of the bat. When the bat is swung the insert is deterred or prevented from moving axially within the hitting portion by one of a plurality of embodiments described below. Since the multi-layer insert is not fastened or attached to the bat frame in any manner, when the ball makes contact with the bat, the insert is able to absorb a greater amount of the energy than inserts of prior art bats that are physically attached to the bat frame. The greater energy absorbed in turn causes a larger rebound effect. The sum total of the rebound effect of the wall of the hitting portion of the bat and the insert is greater than prior art bats resulting in a higher performance bat. The insert will also dampen vibrations by not being connected to the frame of the bat and by compressing against the wall on the side opposite of the impact.

When a bat contacts a ball, the wall of the bat is deformed and the insert moves against the inner wall of the bat opposite where the ball is struck. Both walls of the bat insert compress and then rebound in the direction of the struck ball, providing additional force to the ball as it leaves the bat.

Figure 7:
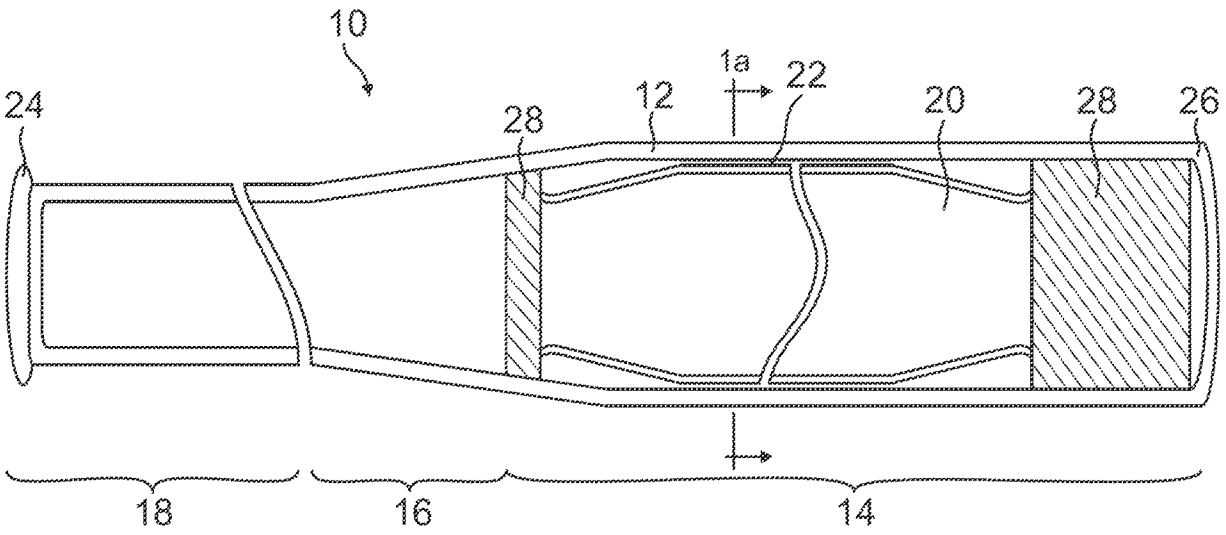
FIG. 7 illustrates the floating insert in an embodiment of the system.

FIG. 7 illustrates one embodiment of the system where the bat insert is separated from the inner diameter of the bat using foam at the ends of the insert. Bat 10 comprises frame 12 that contains a relatively large-diameter hitting portion 14, an intermediate tapering portion 16, and a relatively small-diameter handle portion 18. A knob 24 closes the opening at handle portion 18. Foam 28 is a high density foam that is longer than insert 20 and in its resting state has a diameter greater than the diameter of insert 20. Foam 28 is compressed and then inserted into insert 20 such that it protrudes out of both ends of insert 20 with a greater protrusion out of the end of insert 20 that is closest to cap 26. The foam may be adhered to the frame by an adhesive. Finally cap 26 closes the opening at hitting portion 14. At no point does insert 20 come into contact with frame 12 when the bat is at rest see gap 22) allowing insert 20 to freely move within the hitting portion 14 to both absorb energy by elastic deformation and to dampen vibrations by compressing against the wall of hitting portion 14 on the side opposite to the point of impact.

The bat insert 20 of FIG. 7 may be any of the multi-walled embodiments of FIGS. 1-6. In one embodiment, the foam also fully or partially surrounds the insert 20 and is located between the inner diameter of bat 10 and the outer wall of the bat insert 20 and touching the inner surface of the barrel of the bat.

Figure 8:
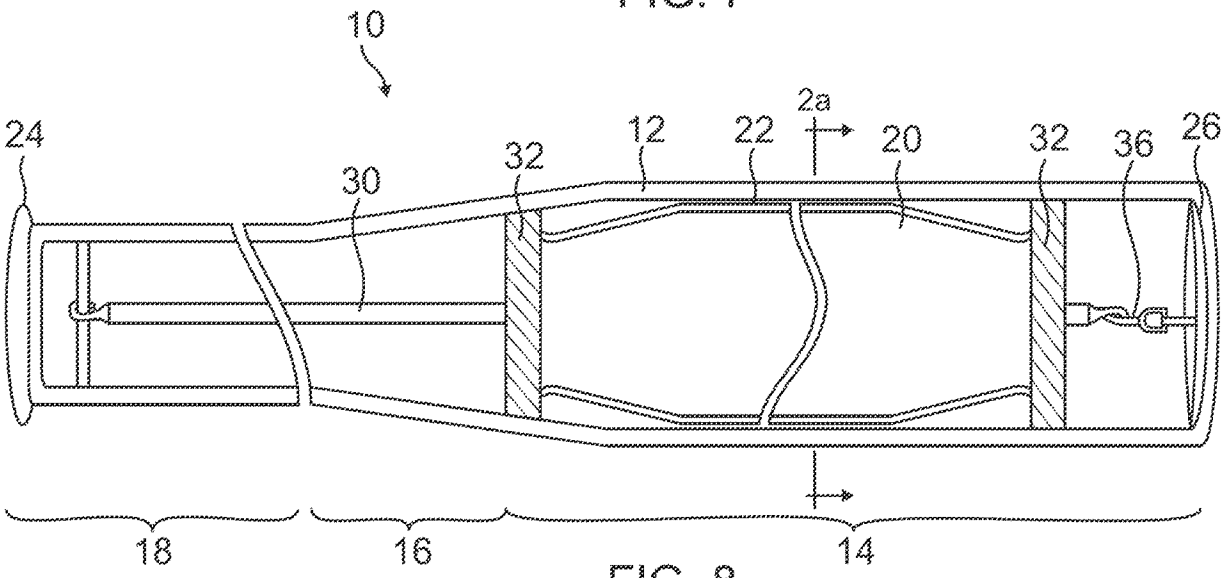
FIG. 8 illustrates the floating insert in another embodiment of the system.

Another embodiment of the present invention is shown in FIG. 8. Bat 10 comprises frame 12 that contains a relatively large-diameter hitting portion 14, an intermediate tapering portion 16, and a relatively small-diameter handle portion 18. A knob 24 closes the opening at handle portion 18. Knob 24 contains an eyelet or other suitable fixture where line 30 is connected. Line 30 may be connected to knob 24 by a knot, adhesive, hook, or any other suitable means. Line 30 may be made of rope, wire, catgut, or of any material with a high tensile strength. Foam 32 is a high density foam that has a diameter greater than the diameter of insert 20, is longer than insert 20, and along its axis contains a channel (not shown). Foam 32 is compressed and then inserted into insert 20. Line 30 is then passed through the channel and connected to rubber strap 36 on the opposing side of insert 20. As cap 26 closes the opening at hitting portion 14 any slack in rubber strap 36 is removed. Rubber strap 36 keeps line 30 rigid so that insert 20 will not come into contact with frame 12 when the bat is at rest (see gap 22); allowing insert 20 to freely move within the hitting portion 14 to both absorb energy by elastic deformation and to dampen vibrations by compressing against the wall of hitting portion 14 on the side opposite to the point of impact.

Figure 9:
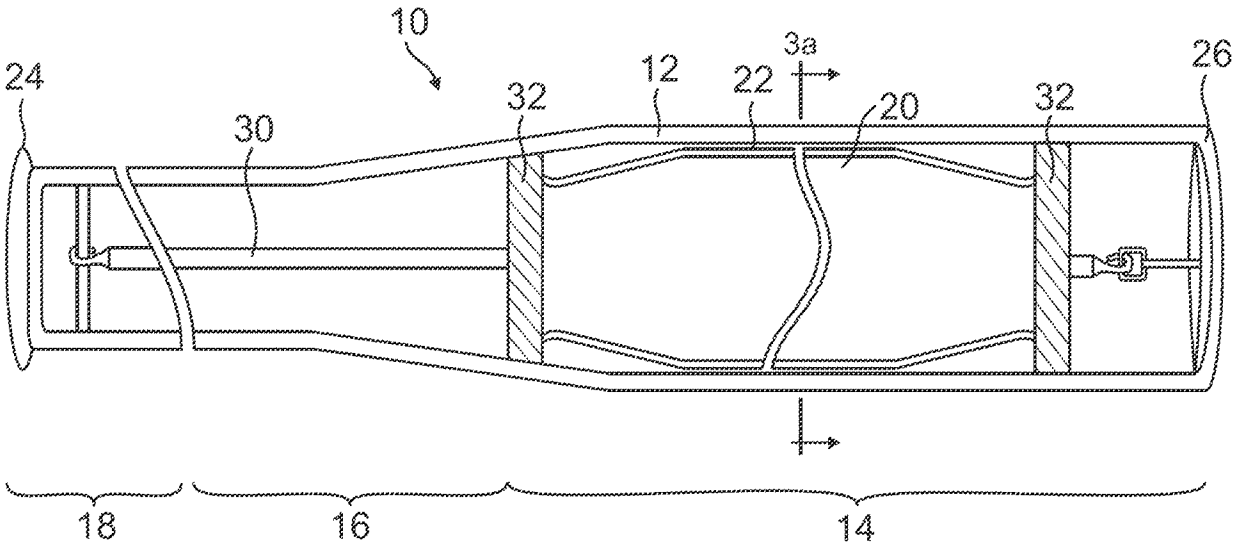
FIG. 9 illustrates the floating insert in another embodiment of the system.

Another embodiment of the present invention is shown in FIG. 9. This embodiment is the same as the embodiment shown in FIG. 8 with the exception that rubber strap 36 has been removed and line 30 passed through the length of frame 12 from knob 24 to cap 26. As cap 26 closes the opening at hitting portion 14 any slack in line 30 is removed so that insert 20 will not come into contact with frame 12 when the bat is at rest (see gap 22); allowing insert 20 to freely move within the hitting portion 14 to both absorb energy by elastic deformation and to dampen vibrations by compressing against the wall of hitting portion 14 on the side opposite to the point of impact.

Figure 10:
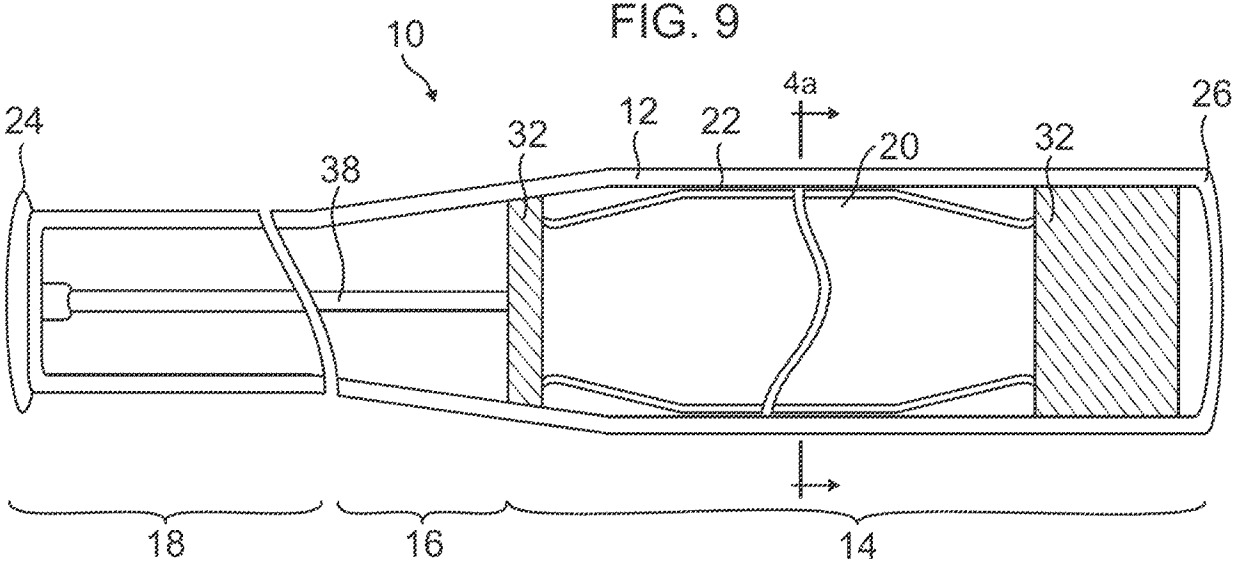
FIG. 10 illustrates the floating insert in another embodiment of the system.

Another embodiment of the present invention is shown in FIG. 10. This embodiment discloses bat 10 comprising of frame 12 that contains a relatively large-diameter hitting portion 14, an intermediate tapering portion 16, and a relatively small-diameter handle portion 18. A knob 24 closes the opening at handle portion 18. Tube 38 is attached to knob 24 and extends through handle portion 18, tapering portion 16, and through insert 20. Foam 32 is a high density foam that has a diameter greater than the diameter of insert 20, is longer than insert 20, and along its axis contains a channel (not shown). Foam 32 is compressed and then inserted into insert 20. Tube 38 is then passed through the channel. Cap 26 closes the opening at hitting portion 14. Tube 38 positions insert 20 so that it will not come into contact with frame 12 when the bat is at rest (see gap 22); allowing insert 20 to freely move within the hitting portion 14 to both absorb energy by elastic deformation and to dampen vibrations by compressing against the wall of hitting portion 14 on the side opposite to the point of impact.

In one embodiment, the shape of the insert may be effectively cylindrical as shown in FIG. 11. In one embodiment, the cylindrical insert may or may not have end portions such as end portions 101 and 102 of FIG. 1.

In one embodiment, the section of foam 28 near the end cap may be cut so that a section of foam near the end cap 26 is separate from the remainder of the foam near the insert 20.

What is claimed is:

1. A bat, comprising:

a tubular frame having a circular cross-section, the tubular frame including a large diameter hitting portion, an intermediate tapering portion, and a small diameter handle portion; and a single tubular insert having a plurality of walls, positioned within the large diameter hitting portion of the tubular frame such that there is an air gap between the entire length of the tubular insert and the tubular frame and wherein the single tubular insert comprise a first outer wall and a second inner wall in the single tubular insert, wherein there is a gap between the first outer wall and the second inner wall, and wherein the diameter of the inner wall does not vary over the length of the insert.

2. The bat of claim 1 further including a foam fitted within the single tubular insert, wherein the single tubular insert has first and second ends, and the foam protrudes beyond the first and second ends and has a diameter such that the foam contacts the tubular frame.

3. The bat of claim 2 wherein further including a section of foam disposed adjacent the foam protruding from the second end of the single tubular insert and disposed between the single tubular insert and a cap of the bat.

4. The bat of claim 1 further including a center region of the single tubular insert that is flat in cross section.

5. The bat of claim 1 further including a center region of the single tubular insert that is curved in cross section.

* * * * *